US006076668A

United States Patent [19]

Keane et al.

[11] Patent Number: 6,076,668

[45] Date of Patent: Jun. 20, 2000

[54] GOLF HEAD COVER ORGANIZER

[76] Inventors: Vincent Keane, 99 Bronte Rd., suite 603, Oakville, Ontario, Canada, L6L 3B7; Douglas Young, 14 Buckingham Drive, Hamilton, Ontario, Canada, L9C 2G5

[21] Appl. No.: 09/224,539

[22] Filed: Dec. 31, 1998

[51] Int. Cl.[7] ..... A63B 57/00

[52] U.S. Cl. ..... 206/315.4; 206/315.4; 150/160; 224/274

[58] Field of Search ..... 150/160, 159; 206/315.3, 315.4; 224/274

[56] References Cited

U.S. PATENT DOCUMENTS

| | | | |
|---|---|---|---|
| 3,015,351 | 1/1962 | Harris | 206/315.4 |
| 4,032,054 | 6/1977 | Duncan | 224/274 |
| 4,383,563 | 5/1983 | Kirchhoff, Jr. | 206/315.3 X |
| 4,459,827 | 7/1984 | Rhodes | 224/274 X |
| 5,072,867 | 12/1991 | Zingale | 206/315.3 X |
| 5,361,958 | 11/1994 | Fiegel et al. | 224/274 |
| 5,450,954 | 9/1995 | Dunn | 206/315.3 X |
| 5,555,589 | 9/1996 | Moultrie | 224/274 X |
| 5,722,125 | 3/1998 | Vasilopoulos | 150/160 X |
| 5,870,023 | 2/1999 | Jackson | 206/315.3 X |

*Primary Examiner*—Sue A. Weaver
*Attorney, Agent, or Firm*—Michael I. Kroll

[57] ABSTRACT

The present invention 10 discloses a device which attaches to the upper exterior of a golfbag 14 and is used to secure golf club covers 18 and the golf clubs 16 therein in the vicinity of the top of the golfbag so that the user 12 can have ready access. The present invention 10 discloses a device which has multiple spring-loaded tensioning lines 22 which lines are connected by connectors 28 to the top of the individual golf club covers 18. The lines 22 are lockably extendible and retractable having clip-like fasteners 26 which can be attached to the top of the golf club covers 18 so as to secure the golf club cover 18 in close proximity to the top of the golfbag 14. The housing 11 of the device is attached to the golfbag 14 by a belt 24. An alternative embodiment is disclosed wherein the housing of the present invention is molded into the golfbag 14.

1 Claim, 10 Drawing Sheets

GOLF HEAD COVER ORGANIZER

BACKGROUND OF THE INVENTION

1. Field of the Invention

The present invention relates generally to golf equipment and, more specifically, to a device which attaches to the upper exterior of a golfbag using an adjustable belt or fasteners wherein said device having a plurality of locking extendible and retractable lines having clip-like fasteners which selectively attach to golf club covers providing means for selectively extending said line, removing said golf club covers, selectively retracting said line, thereby securing said golf club cover in close proximity to the top of the golfbag, removing, using, and returning said golf club and selectively retrieving said golf club cover, which is in easy reach, extending said line, covering said golf club and giving said line a slight tug which will cause the extending retracting mechanism of said device being under spring pressure to pull said golf club cover toward the device whereby the golf clubs having said covers will be maintained under pressure toward the side of the golfbag having the attached device.

Located within said device is a plurality of tensioning members, each having a clip attached to one distal end of a length of line being maintained on a spool having a ratchet, pawl and coiled spring means providing extension, retraction and selective locking means and wherein said tensioning members are contained within a housing having apertures wherethrough selectively extending and retracting said lines and said housing having flanges for the attachment of an adjustable belt or fasteners.

2. Description of the Prior Art

There are other means currently available using line cord which allows for the removal of the golf club cover but these lines are inherently long and have a tendency to become tangled with one another and are not within easy reach when recovering the golf club and become tangled with the clubs themselves.

While these may be suitable for the purposes for which they were designed, they would not be as suitable for the purposes of the present invention, as hereinafter described.

SUMMARY OF THE PRESENT INVENTION

The present invention discloses a device which attaches to the upper exterior of a golfbag and is used to secure golf club covers and the golf clubs therein in the vicinity of the top of the golfbag so that the user can have ready access. The present invention discloses a device which has multiple spring-loaded tensioning lines which lines are connected by connecting means to the top of the individual golf club covers. The lines are lockably extendible and retractable having clip-like fasteners which can be attached to the top of the golf club covers so as to secure the golf club cover in close proximity to the top of the golfbag. The housing of the device is attached to the golfbag by a belt. An alternative embodiment is disclosed wherein the housing of the present invention is molded into the golfbag.

A primary object of the present invention is to provide a compact, efficient and economical means for the use and care of golf club covers.

Another object of the present invention is to provide a device having a plurality of selectable lines having clips attached at one distal end providing means for securing said lines to golf club covers.

Yet another object of the present invention is to provide a device having a number of selectably lockable extendible and retractable lines having clips attached at one distal end providing means for securing said lines to golf club covers.

Additional objects of the present invention will appear as the description proceeds.

The present invention overcomes the shortcomings of the prior art by providing a device which attaches to the upper exterior of a golfbag using an adjustable belt or fasteners wherein said device having a plurality of locking extendible and retractable lines having clip-like fasteners which selectively attach to golf club covers providing means for selectively extending said line, removing said golf club covers, selectively retracting said line, thereby securing said golf club cover in close proximity to the top of the golfbag, removing, using, and returning said golf club and selectively retrieving said golf club cover, which is in easy reach, extending said line, covering said golf club and giving said line a slight tug which will cause the extending retracting mechanism of said device being under spring pressure to pull said golf club cover toward the device whereby the golf clubs having said covers will be maintained under pressure toward the side of the golfbag having the attached device.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
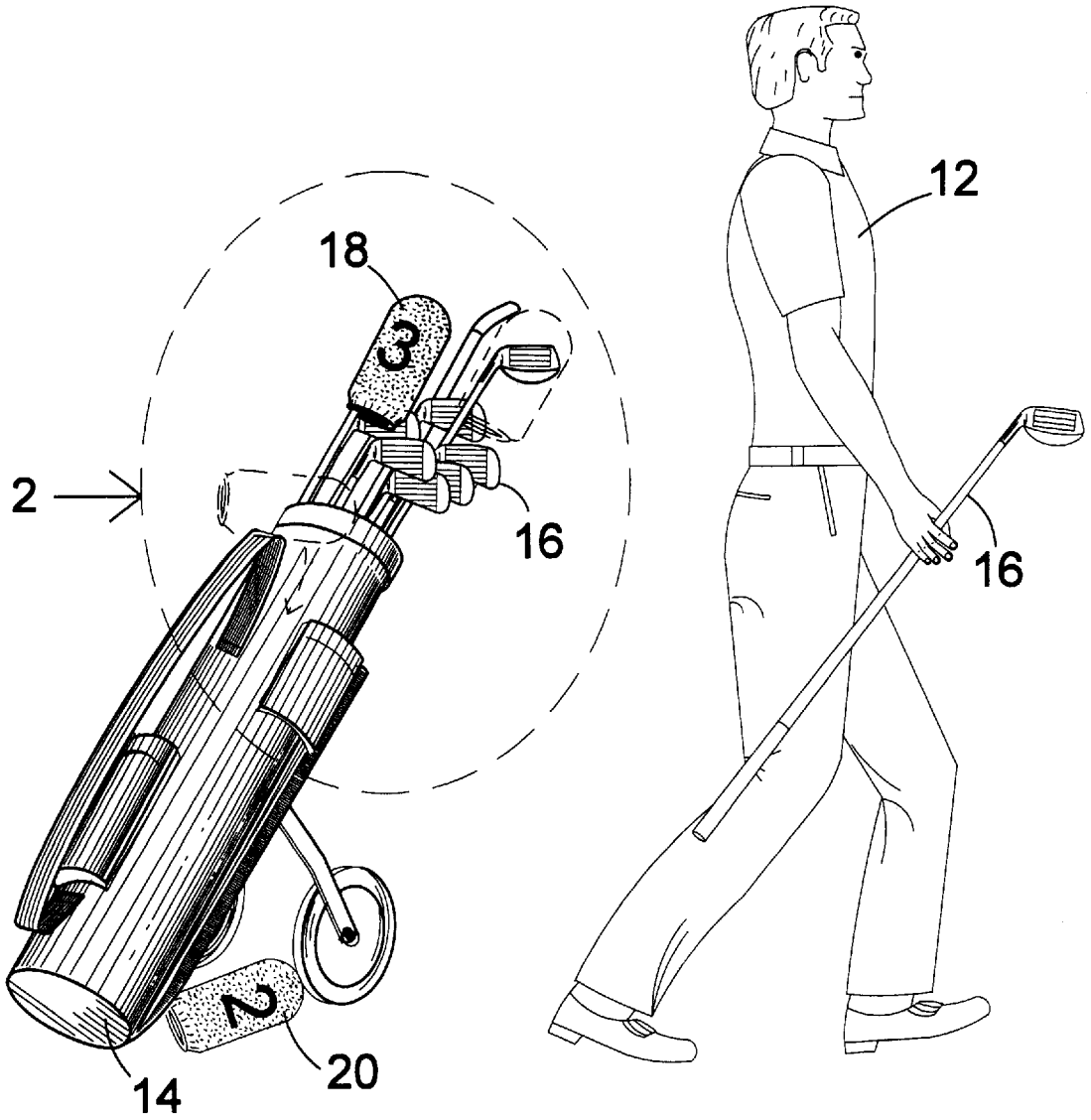
PRIOR ART FIG 1
FIG. 1 is a perspective view of one scenario of the prior art wherein when the golf club covers are removed while using the golf club the covers can be inadvertently left behind due to the concentration of the user being placed on the execution of the game and not on the equipment.

With regard to the reference numerals used, the following numbering is used throughout the various figures.

10 present invention
11 housing
12 user
14 golfbag
16 golf club
18 golf club cover
20 number
22 tensioning line
24 belt
26 clip
28 attachment means
30 apertures
32 base of housing
34 slots for belt
36 male belt connecting means
38 female belt connecting means
40 upper housing
42 lower housing
44 spring compartment
46 line spool
47 spool shaft
48 ratchet
50 pawl
52 screws
54 screw apertures
56 screw threads
58 spring
59 spring cover
60 lock washer
62 pawl post

DESCRIPTION OF THE PREFERRED EMBODIMENT(S)

Turning now descriptively to the drawings, in which similar reference characters denote similar elements throughout the several views, FIGS. 1 through 10 illustrate the present invention being an organizer for golf club covers.

Turning to FIG. 1, therein is shown a perspective of one scenario of the use of the prior art golf club covers. Therein is shown the user 12, along with the golfbag 14, a number of golf clubs 16, and prior art golf club covers 18 showing the number of the club 20 which the golf club cover relates to. The purpose of the golf club cover 18 as used in the prior art is to protect the golf clubs from being physically damaged or scratched, therefore, normally the covers were used on the woods. FIG. 1 shows how the covers 18 could be removed from the golf club 16 and then be inadvertently left behind due to the user 12 being focused on the golf match and not on the equipment.

Figure 2:
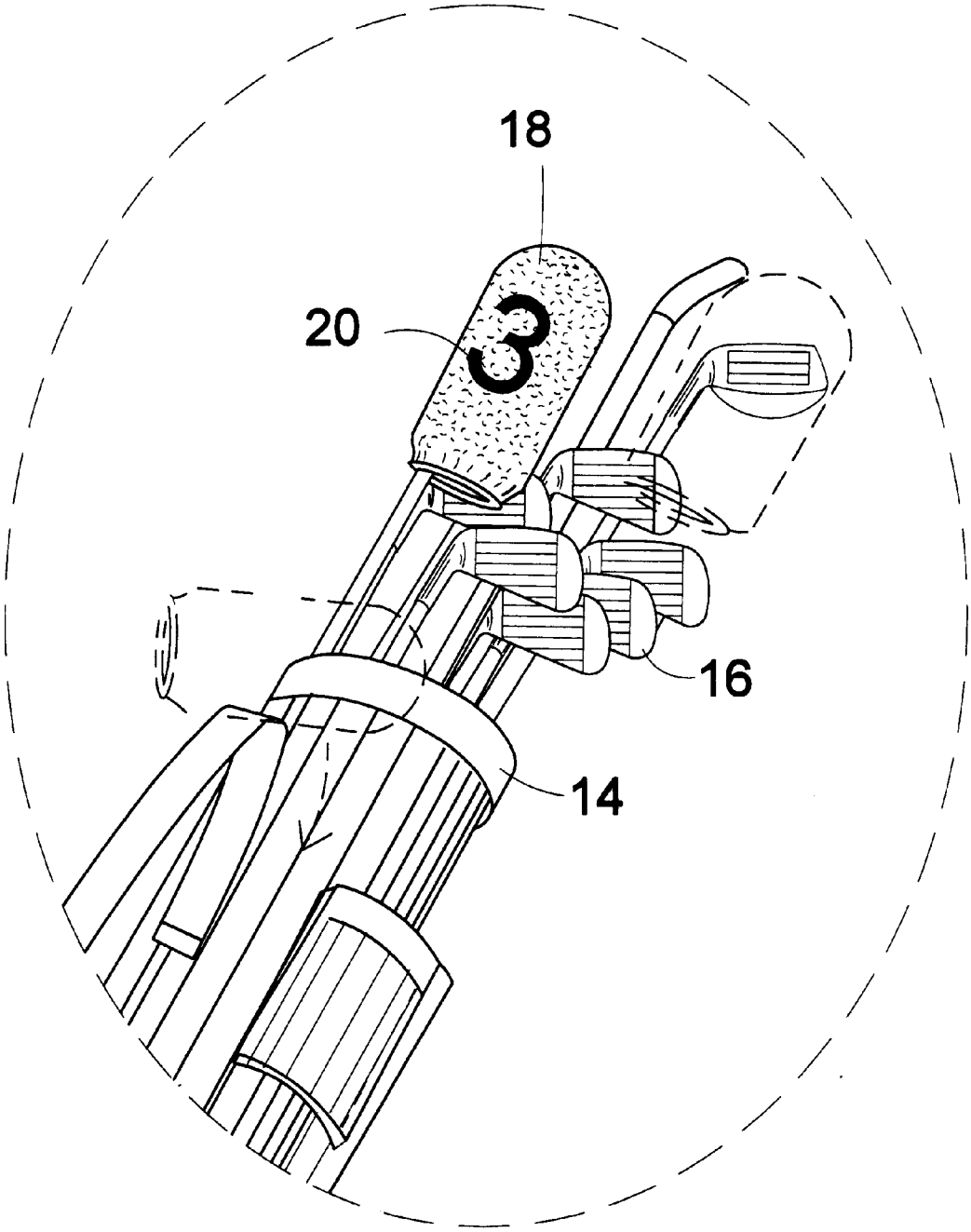
PRIOR ART FIG 2
FIG. 2 is an enlarged perspective view, taken from FIG. 1 as indicated showing the clubs having no organization and the difficulty which can be encountered in easily identifying any of the irons due to the length of the drivers and the size of the driver covers which block viewing of many of the clubs.

Turning to FIG. 2, therein is shown an enlarged perspective taken from FIG. 1, as indicated, showing the golf clubs 16 having no particular organization and the difficulty which can be encountered in identifying any of the golf clubs 16 due to the varying length of the golf clubs 16 and the size of the golf club covers 18 which may block the view of many of the clubs. Therein is shown the golfbag 14, golf clubs 16, and a conventional golf club cover 18, along with the number of the club 20 shown on the golf club cover 18. Also shown in outline is a golf club cover which is loose and falling toward the ground.

Figure 3:
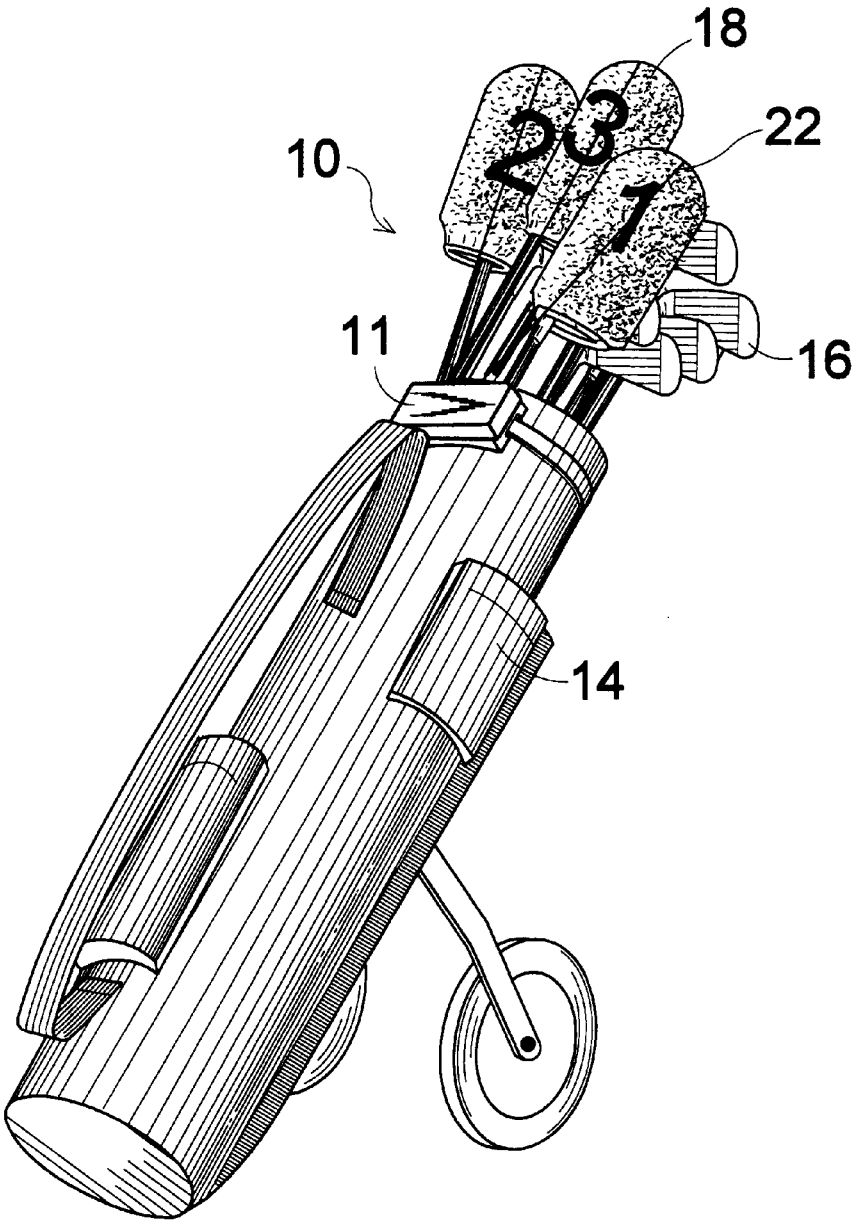
FIG. 3 is a perspective view of the present invention installed on a typical golfbag. The device having a plurality of tensioning lines will hold the clubs having covers, which are typically the woods, against the side of the bag whereupon the device is installed, thereby improving visibility and access to all clubs.

Turning to FIG. 3, therein is shown a perspective view of the present invention 10 installed on a typical golfbag 14. The device 10 has a plurality of tensioning lines 22 which have means to attach to the golf club covers 18 which typically are used on the golf clubs referred to as woods. Note that the golf clubs to which the present invention 10 are attached are generally held by the tensioning lines 22 against the side of the golfbag 14 to which the device is installed thereby improving visibility and access to all clubs.

Figure 4:
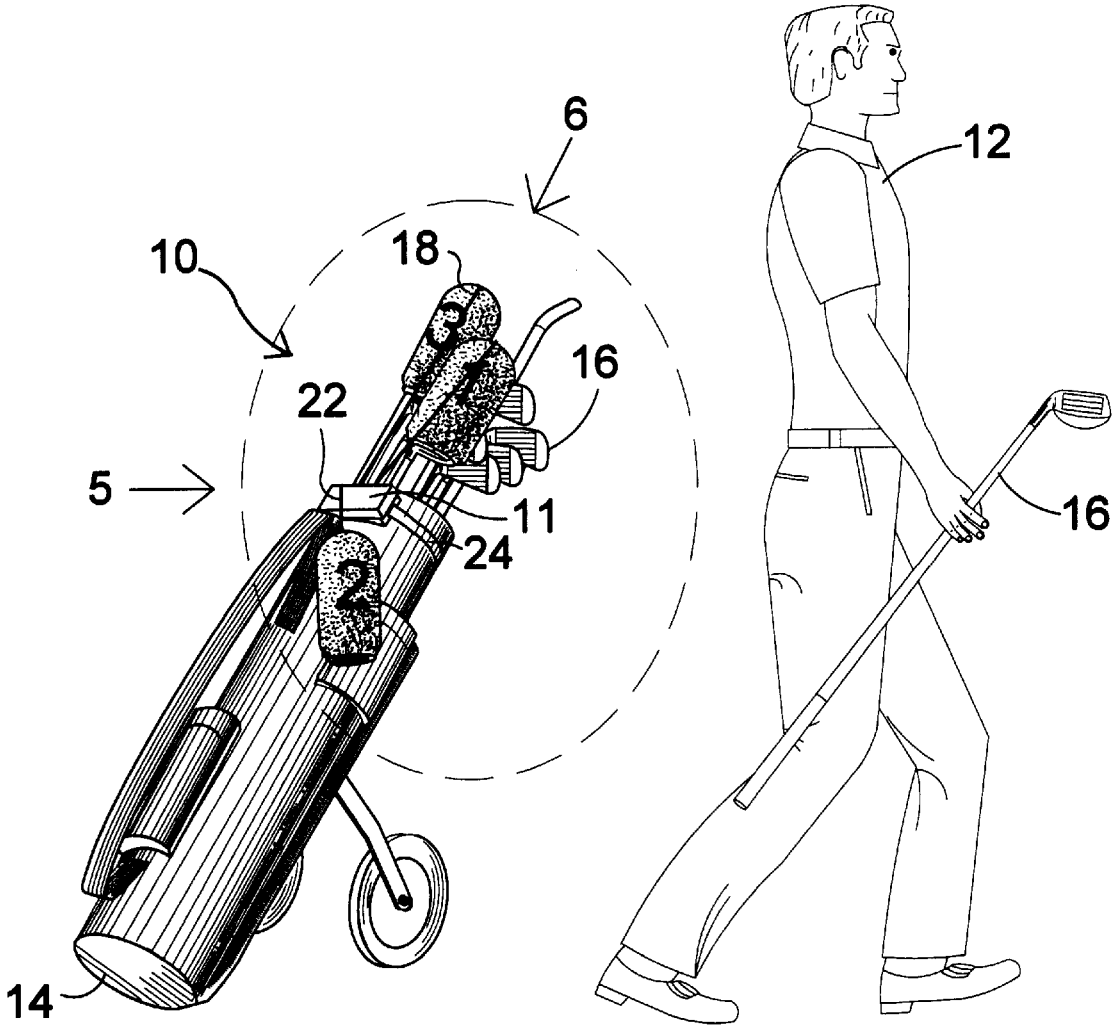
FIG. 4 is a perspective view of the present invention in use. Shown are a number of golf clubs having covers which are attached to the golf head cover organizer by a selectively lockable extendible and retractable line.

Turning to FIG. 4, therein is shown a perspective view of the present invention 10 in operative connection on the golfbag 14. Shown are a number of golf clubs 16 having covers 18 which are attached to the golfhead cover organizer 10 by selectively lockable, extendible and retractable lines 22. Also shown is the user 12. It can be seen that the present invention 10 is attached to the golfbag 14 with an adjustable strap 24 or other means which encircles the golfbag 14 and has attaching means to the golfbag.

Figure 5:
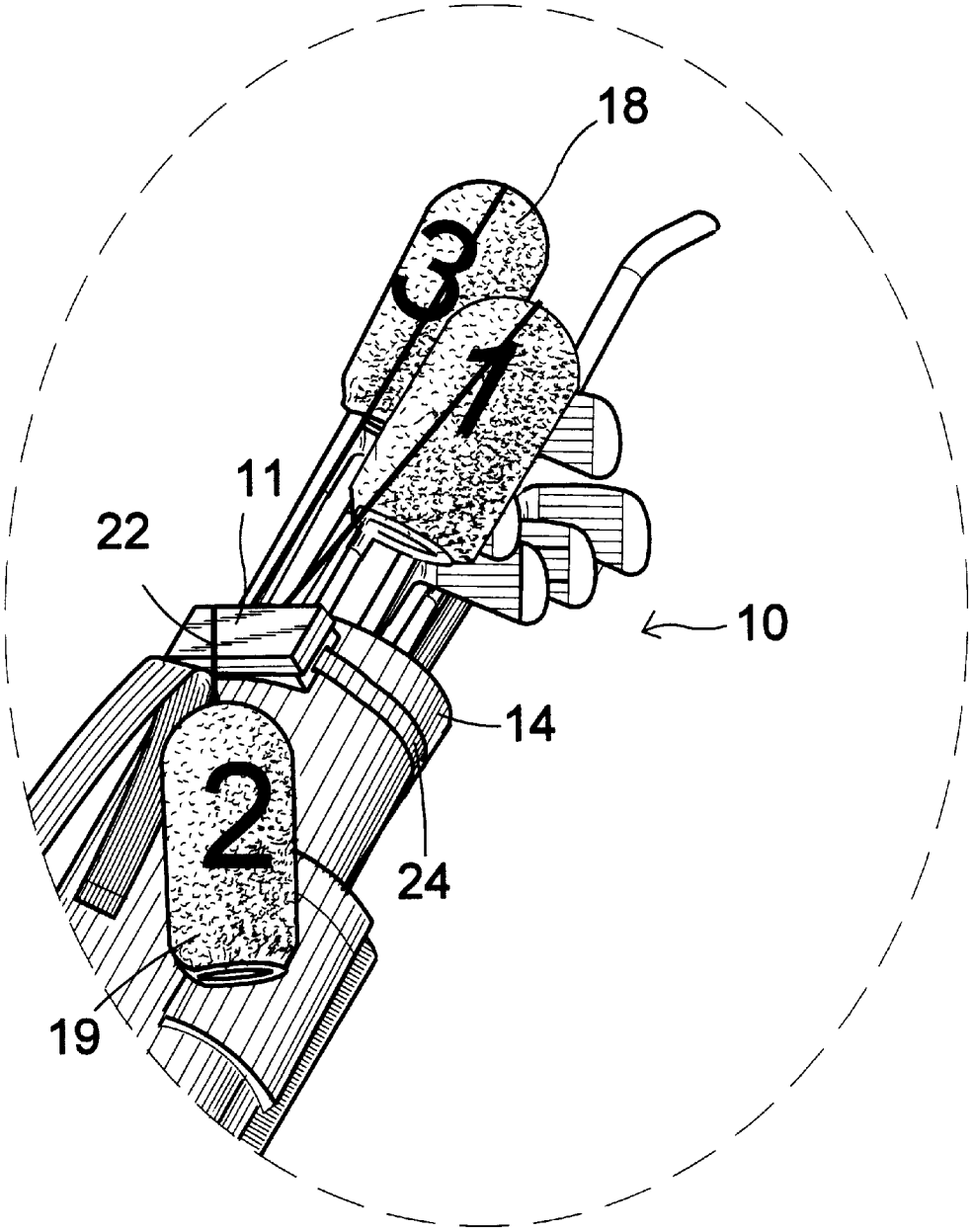
FIG. 5 is an enlarged perspective view of the present invention, taken from FIG. 4 as indicated. Shown are a number of golf club covers being held to the back of the golfbag by an equal number of tensioning lines. Also shown is a cover being held in a non-operative position and easily accessible to the user.

Turning now to FIG. 5, therein is shown an enlarged perspective view of the present invention 10 taken from FIG. 4 as indicated. Shown are a number of golf club covers 18 being held to the side of the golfbag 14 by an equal number of tensioning lines 22. Also shown is the housing of the present invention 11 having its strap 24 encircling the golfbag and holding the housing 11 to the golfbag. Also shown therein is a golf club cover 19 being held in a non-operative position but yet easily accessible to the user indicating how the tensioning line 22 can hold the cover 19 in a position so that the user 12 (not shown) can easily access the cover.

Figure 6:
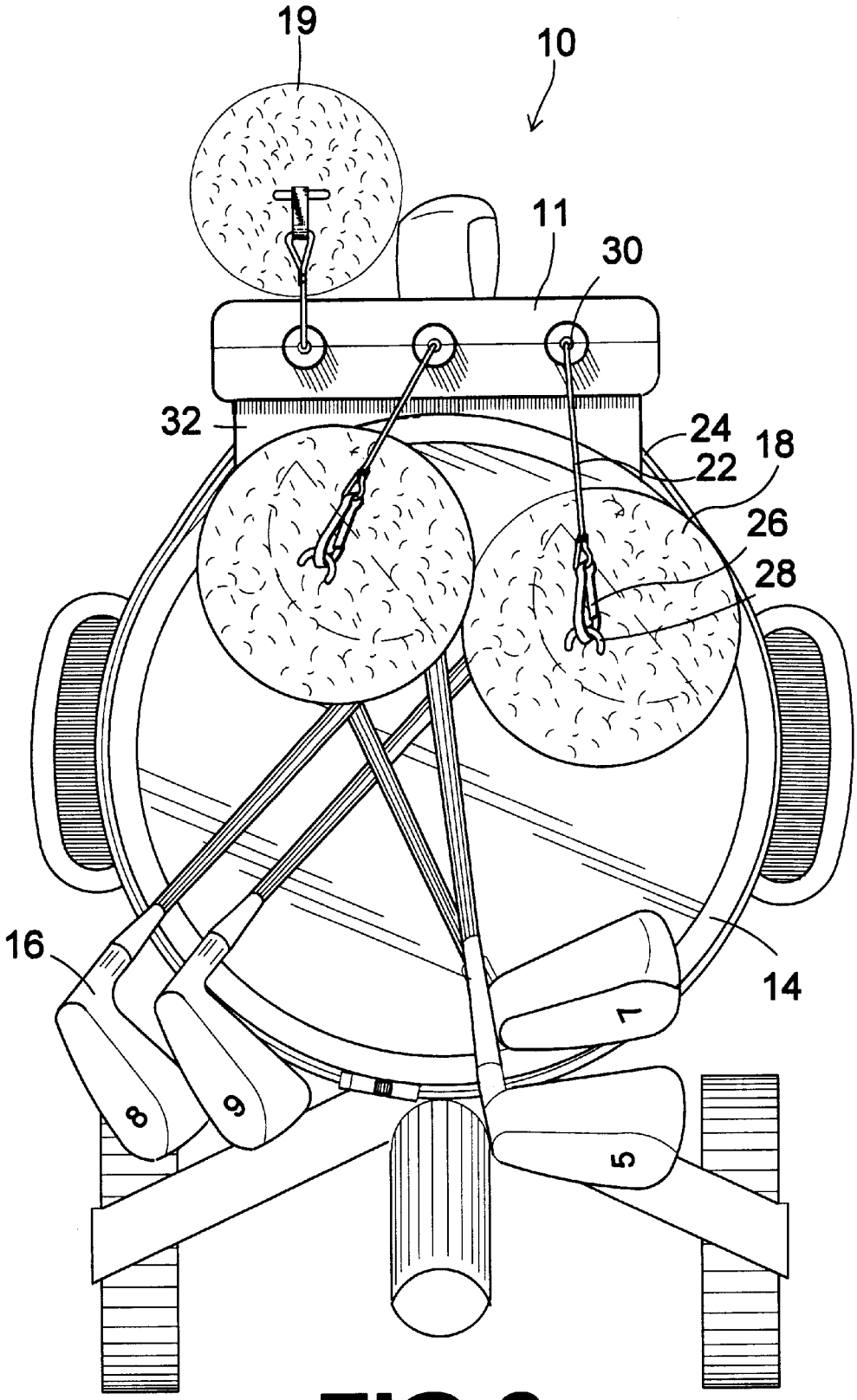
FIG. 6 is an enlarged perspective view of the top of the present invention, taken from FIG. 4 as indicated. Shown are a number of golf club covers being held to the side of the golfbag by an equal number of tensioning lines. Also shown is a cover being held in a non-operative position and easily accessible to the user.

Turning to FIG. 6, therein is shown an enlarged perspective view of the top of the present invention 10 taken from FIG. 4 as indicated. Shown are a number of golf clubs within club covers 18 in normal operative connection being held to the side of the golfbag 14 by an equal number of tensioning lines 22. Also shown is a cover 19 being held in a non-operative position yet easily accessible to the user. Also shown are a number of golf clubs 16. Also shown is the housing of the present invention 11 along with attaching means, i.e., clips 26 which connect the tensioning lines 22 to the top of the covers 26 by being clipped onto circular ring-like or other attachment means 28 on the top of each individual golf club cover 18. It can be seen that the tensioning lines 22 travel into the housing 11 of the present invention through apertures 30 which are shown on the top of housing 11. Also shown is the strap means 24 for connecting the present invention to the golfbag 14. Also shown is the curved mounting base 32 or flange of the housing 11 which is curved to accommodate the circular form of the golfbag 14.

Figure 7:
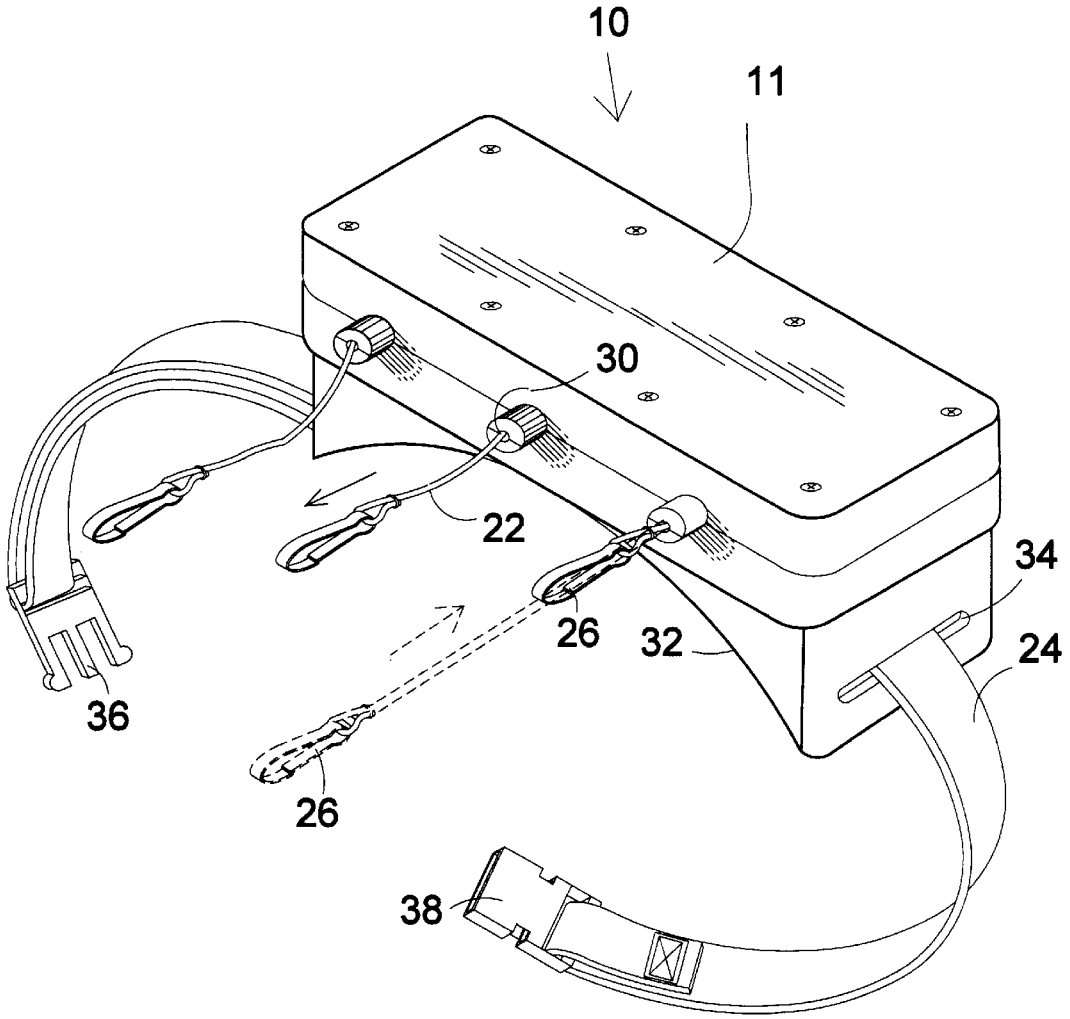
FIG. 7 is a perspective view of the present invention. Shown is a device having a number of apertures wherethrough lines are selectively extended and retracted and wherein said lines have clips located on one distal end serving as means for attachment to the golf club cover. Also shown is an adjustable belt which is one means for attaching the device to the upper portion of the golfbag.

Turning to FIG. 7, therein is shown a perspective view of the present invention 10. Shown is a device 10 having a number of apertures 30 wherethrough lines 22 are selectively extended and retracted and wherein said lines 22 have clips 26 located on one distal end serving as means for attachment to the golf club covers (not shown). Also shown is an adjustable belt 24 which is one means for attaching the device to the upper portion of the golfbag. Also shown is the housing of the present invention 11 showing its curved inner surface or base flange 32 for encircling the golfbag (not shown). Also shown is a notch-like aperture 34 through which the belt 24 travels in order to hold the housing 11 to the golfbag. The strap 24 is further equipped with male 36 and female 38 connecting means whereby the opposite ends of the belt 24 can be connected to each other.

Figure 8:
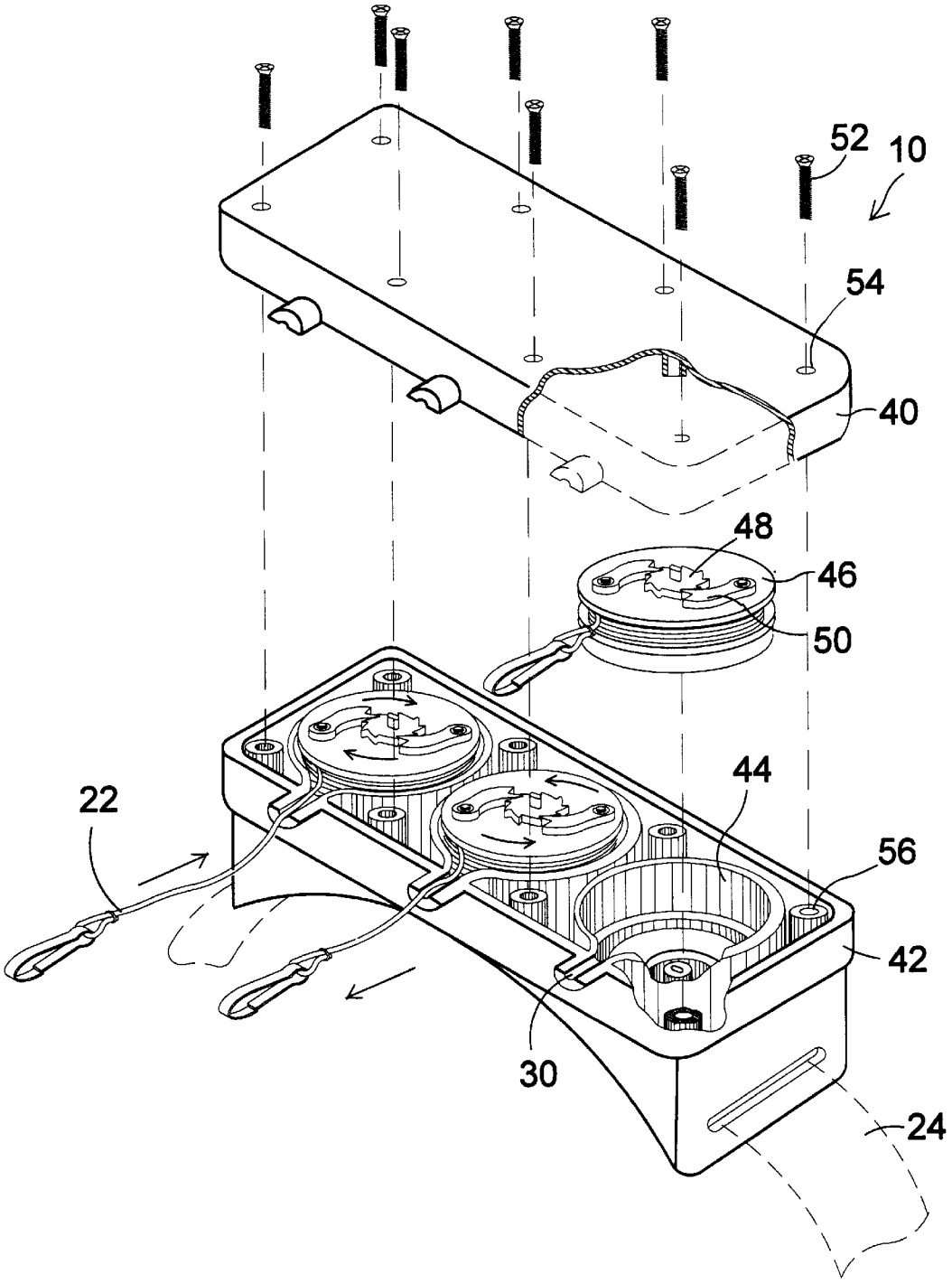
FIG. 8 is a partially exploded view of the present invention. Shown are upper and lower casing members having a plurality of compartments wherein each compartment houses a spring (not shown), a line spool, and a ratchet and pawls working in concert with the spring providing means for extending, locking, and retracting the line.

Turning to FIG. 8, therein is shown a partially exploded view of the present invention 10. Shown are the upper 40 and lower 42 housing members having a plurality of circular compartments 44 wherein each compartment houses a spring assembly (not shown), the line spool 46, a ratchet 48 along with pawls 50 wherein working in concert spring-providing means is used for extending, locking and retracting the line 22. Also shown are the apertures 30 formed by the mating of the upper housing 40 and lower 42 housing, along with numerous attaching means 52, e.g., screws, which connect the upper housing 40 through numerous apertures 54 to attachment means 56, e.g., threaded screw holes of the lower housing 42.

Figure 9:
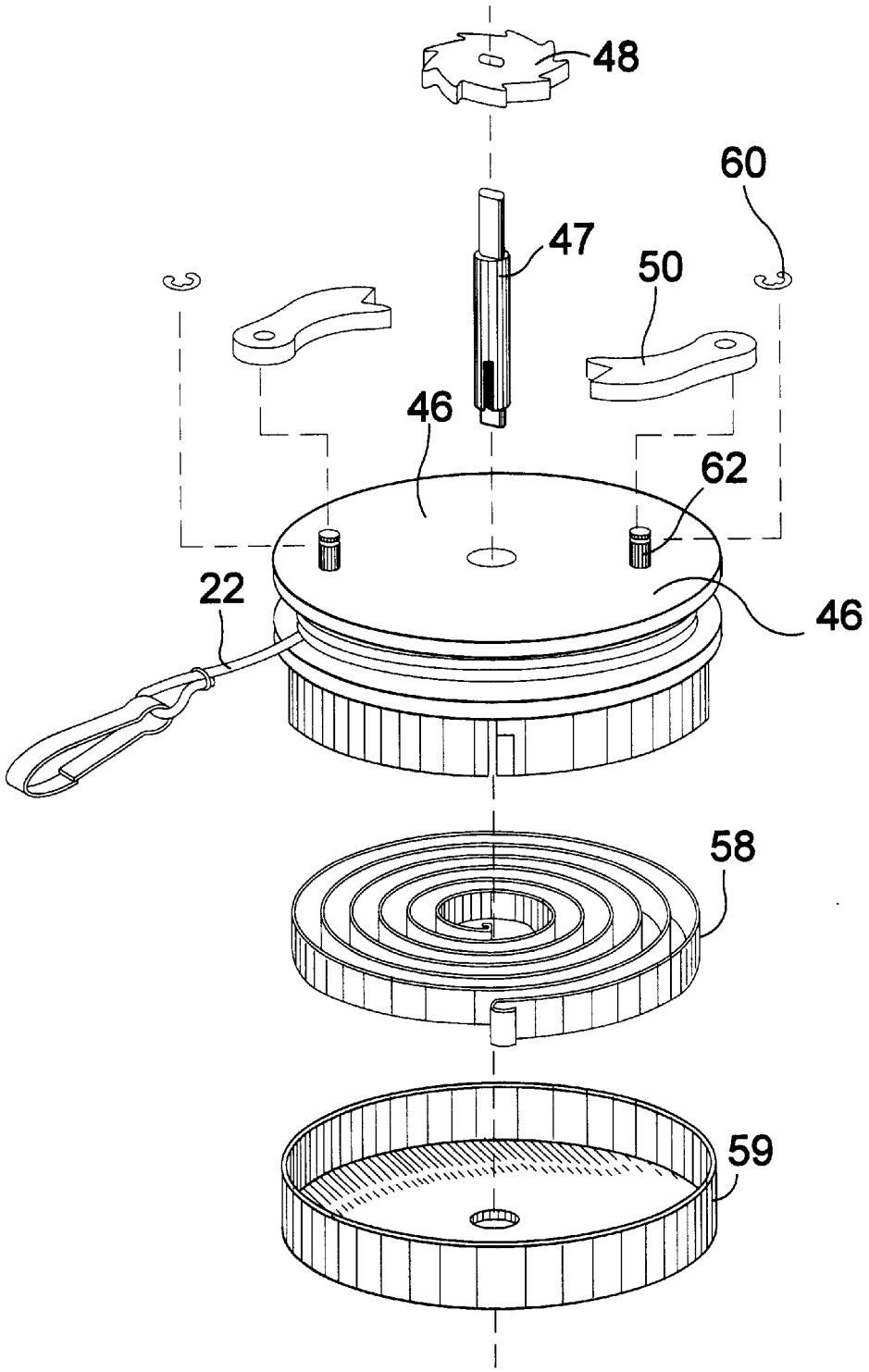
FIG. 9 is an exploded view of line control components wherein the line is wound around a spool. As the line is extended the spring is wound. When the line is released the ratchet and pawl provide locking means. A slight tug on the line engages the locking mechanism and the line can be selectively retracted to any predetermined point.

Turning to FIG. 9, therein is shown an exploded view of the line control components wherein the line 22 is wound around a spool 46. The spool 46 rotates around a center shaft 47. Also shown are the ratchet 48 and multiple pawls 50 having lock washers or other locking means 60 for attachment of the pawls 50 which rotate about individual posts 62 located on the upper surface of the spool 46. Also shown is the spool spring 58 along with a lower cover for the spool 59 which encloses the spring 58 and keeps it held within the spool 46. It should be clear that this spring spool 46 and related components is constructed and operates in a standard manner and provides means for selectively extending, retracting, and locking the line 22. As the line 22 is extended the spring 58 is wound more tightly. When the line is released the ratchet 48 and pawl 50 provide locking means. A slight tug on and release of the line 22 disengages the locking mechanism and the line 22 can be selectively retracted to any predetermined point.

Figure 10:
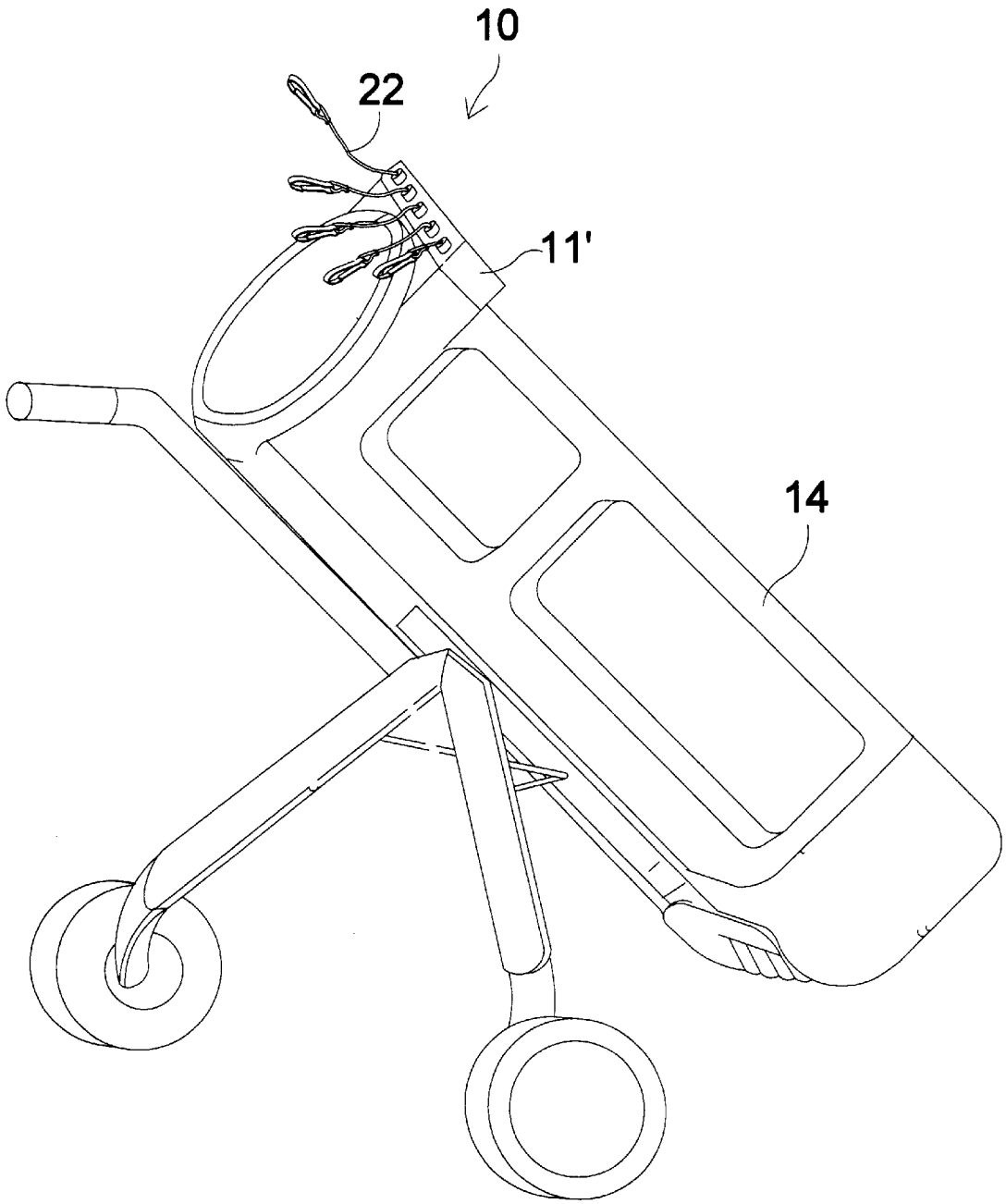
FIG. 10 is a perspective view of an alternate embodiment of the present invention molded into a typical golfbag. The device having a plurality of tensioning lines will hold the clubs having covers, which are typically the woods, against the side of the bag whereupon the device is installed, thereby improving visibility and access to all clubs.

Turning to FIG. 10, therein is shown a perspective view of an alternate embodiment of the present invention 10 with the housing 11' molded into a typical golfbag 14. The device has a plurality of tensioning lines 22 which will hold the clubs having covers, which are typically the woods, against the side of the bag 14 whereupon the device is installed, thereby improving visibility of and access to all clubs.

What is claimed is new and desired to be protected by Letters Patent is set forth in the claims:

1. An apparatus for organizing golf club covers, comprising:

a) a housing;

b) said housing further comprising means for attachment to a golfbag, said attachment means including a belt for strapping said housing to said golfbag;

c) a plurality of golf club covers having an open side and a closed side, with a loop member attached to said closed side; and d) means for connecting said covers to said housing whereby said covers have ready access to the user comprising a flexible line for each cover, each flexible line having one end releasably attached to said loop member;

e) said housing containing a plurality of circular compartments, each compartment containing means for selectively extending, locking and retracting a flexible line comprising a spring, a line spool, and a locking mechanism consisting of a ratchet engaged with a pair of pawls mounted on said line spool;

f) said housing having a main body and a cover, an opening adjacent each of said compartments between said cover and said main body facing said golfbag and above an opening into said golfbag, each flexible line from each golf club cover passing through one said opening to and wound on a line spool so that as a flexible line is extended the spring is wound more tightly and when released said ratchet and pawl provide locking of the spool while a slight tug on and release of the flexible line disengages the locking mechanism; and g) said compartments in said housing being lined in a row with each line spool in each compartment being arranged in a horizontal plane for rotation around a vertical extending center shaft with said ratchet mounted on said center shaft.

* * * * *